US008452195B2

(12) United States Patent
Rossell et al.

(10) Patent No.: US 8,452,195 B2
(45) Date of Patent: May 28, 2013

(54) DIAGNOSTIC PLOT FOR ADJUSTING PRINTING CHARACTERISTICS

(75) Inventors: Marti Rius Rossell, Barcelona (ES); Ezequiel Jordi Rufes Bernad, Sant Feliu de Llobregat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 338 days.

(21) Appl. No.: 12/878,590

(22) Filed: Sep. 9, 2010

(65) Prior Publication Data

US 2012/0063800 A1 Mar. 15, 2012

(51) Int. Cl.
*G03G 15/00* (2006.01)

(52) U.S. Cl.
USPC ..... 399/9; 347/19; 399/15; 399/72

(58) Field of Classification Search
USPC ..... 399/9, 15, 45, 72; 347/19
See application file for complete search history.

(56) References Cited

U.S. PATENT DOCUMENTS

| | | | | |
|---|---|---|---|---|
| 6,254,081 | B1 | 7/2001 | Rasmussen et al. | |
| 7,383,016 | B2 | 6/2008 | Lee et al. | |
| 7,413,276 | B2 | 8/2008 | Garcia et al. | |
| 7,461,839 | B2 | 12/2008 | Ikeda | |
| 2002/0196298 | A1 * | 12/2002 | Cheng et al. | 347/9 |
| 2005/0012769 | A1 * | 1/2005 | Hanabusa et al. | 347/14 |
| 2007/0076038 | A1 * | 4/2007 | Plante et al. | 347/19 |
| 2007/0296791 | A1 | 12/2007 | Eve | |
| 2009/0002429 | A1 | 1/2009 | Puigardeu et al. | |
| 2009/0262380 | A1 * | 10/2009 | Puigardeu et al. | 358/1.14 |
| 2010/0020150 | A1 | 1/2010 | Love | |

* cited by examiner

*Primary Examiner* — Sophia S Chen

(57) ABSTRACT

A printing device configured to print a diagnostic plot, the diagnostic plot including a cockle pattern, a main media advance pattern, and a secondary media advance pattern, wherein the cockle pattern, main media advance pattern, and secondary media advance pattern are for providing feedback and for adjusting printing characteristics associated with the printing device. A method of adjusting vacuum levels in a vacuum system of a printing device including generating a diagnostic plot on media; the diagnostic plot including a cockle pattern, a main media advance pattern, and a secondary media advance pattern, and accepting adjustments to printing parameters on the printing device based on printing defects displayed on the diagnostic plot.

20 Claims, 6 Drawing Sheets

DIAGNOSTIC PLOT FOR ADJUSTING PRINTING CHARACTERISTICS

BACKGROUND

Printers have become a major component of any modern business or home office. Indeed, printers have become an invaluable peripheral to any computing system. They are not without their problems however. Most printers today use a type of ink that contains some level of water or other liquid which is absorbed into the print media during the printing process. When this occurs, the media may expand in random locations to varying degrees depending on the amount of ink and type of media used. This absorption creates ripples, wrinkles, or what is known in that art as cockles in the media. Cockling may not only lead to an inferior final printed product, but may also lead to damage to the printer or media. Specifically, if the cockling is significant enough it may lead to the printer's carriage smearing ink on the media or even to the carriage crashing or jamming. These problems are often referred to as carriage smearing or carriage crashing respectively.

Additionally, cockling may occur when media types other than paper are used such as plastic-based medium. In order to better dry the ink which has been deposited on the plastic media, a heat or drying source such as a heat lamp or drying lamp is often used. However, the heat from the drying lamp may cockle the plastic media and thereby again alter the appearance of the final printed product as described above.

To an extent, the cockling of media has been controlled by a vacuum system which comprises a vacuum source coupled to a number of holes in the platen. A negative pressure is then created between the platen and the media being fed into the printer. The use of this vacuum system may better hold the paper to the platen so that it won't wrinkle. However, the level of vacuum pressure used may create its own problems. Specifically, if the vacuum pressure is too low, the media may cockle which, as mentioned above, may lead to carriage smears or crashes. If the vacuum pressure is too high, the printer may not be able to effectively advance the media being printed and the media being used may skew; both of which may cause horizontal banding in the image being printed.

Still further, adjustment of the vacuum level of the vacuum system in order to compensate for any cockling may prove to be difficult, especially if adjusted by an end user. This is because the required vacuum level for any one type of media used is dependent on the rigidity or stiffness of the media. Because it is difficult for the end user to measure stiffness of any one type of media, adjustment of the vacuum level so as to accommodate that type of media has proven to be even more difficult.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
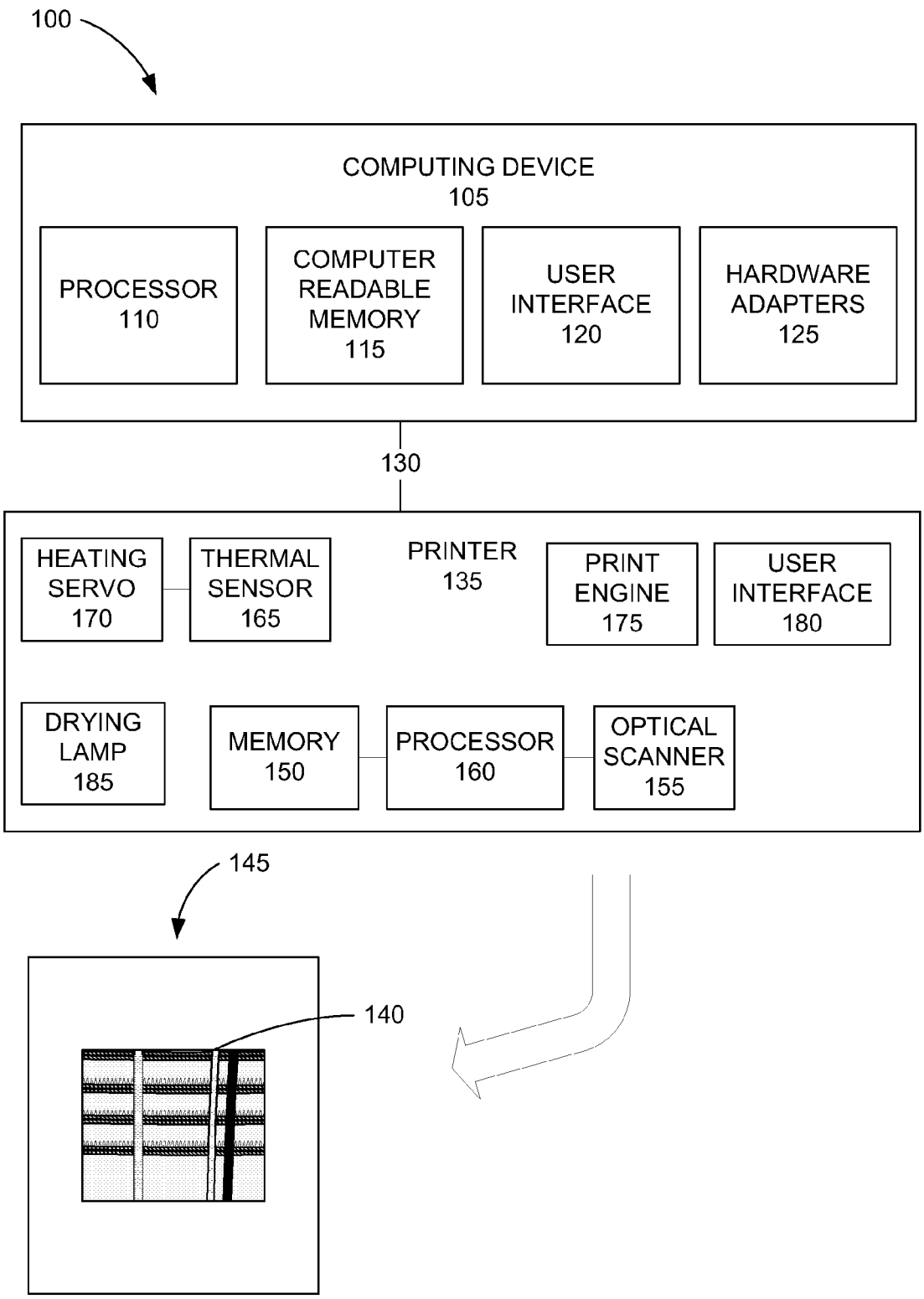
FIG. 1 is a diagram of an illustrative system for diagnosing printing issues, according to one embodiment of principles described herein.

The present specification discloses various methods, systems, and devices for diagnosing and correcting printing defects in printed media. As discussed above there are many advantages to accurately diagnosing printing defects on a media. Some examples of the advantages may include the prevention of unnecessary waste of printing media as well as the prevention of damage to the printing media or the printer.

Specifically, the present specification discloses various methods, systems, and devices for diagnosing and correcting printing defects in a printed media by printing a diagnostic plot and adjusting the vacuum pressure of the vacuum system. As discussed above, various types of media can be used in a printer. For example, with paper media, during the printing process ink is at least partially absorbed into the fibers of the material. As this occurs, the paper may expand in various locations, at various rates, and/or in various degrees. This results in wrinkling or cockling of the paper media. In an attempt to help overcome this issue, vacuum systems may be coupled to a printer's platen. The vacuum is made to be in fluid communication with the printer's platen through a number of holes defined in the platen. Therefore, the vacuum is allowed to hold the media to the platen during printing thereby partially preventing cockling. Still further, however, paper media may also come in a variety of thicknesses. The appropriate vacuum level of the vacuum system is at least partially dependent on the thickness of the media and as such, because the end user may not know the exact thickness of the media being used, adjustment of the vacuum system to the appropriate levels is difficult. Therefore, the diagnostic plot of the present application may indicate if and how the user should adjust the vacuum levels to compensate for ink absorption as well as media thickness.

The problem with cockling of the media, however, is further compounded when alternative types of media are used such as plastic-based media. For example, when a user wishes to print onto a vinyl substrate, a heat lamp or drying lamp is often used to dry or cure the ink being deposited on the substrate. As discussed above, this results in the wrinkling or cockling of the substrate because the heat from the heat lamp may warp the plastic-based media. The user is then left to adjust the vacuum levels in order to help prevent the substrate from cockling. Adjustment of the vacuum levels, at least with plastic-based medias, is not only dependent on the thickness of the media, but also if and to what degree the media is being warped or wrinkled by the drying lamp. Therefore, adjustment by even a trained user may not produce acceptable results. Because the goal is to provide the best results possible, the present method, system, and device provides a way by which even a novice user may adequately adjust the vacuum levels in order to achieve those results.

Therefore, according to one embodiment of the present illustrative system, method and device, in order to determine whether the vacuum level is sufficient, a diagnostic plot may be printed. As a result, adjustment of the vacuum level, even when stiff media or plastic-based media is being used, results in better printer output. Indeed, skillful adjustment of the vacuum level by even a novice user may be accomplished.

In the following description, for purposes of explanation, numerous specific details are set forth in order to provide a thorough understanding of the present systems and methods. It will be apparent, however, that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

As used in the present specification and in the appended claims, the term "cockle" is meant to be understood as a wrinkle, pucker or ripple in the media. As discussed briefly above, cockling typically occurs when either ink has been absorbed into paper media or when heat has been applied to a plastic-based media. Indeed, when a heat source is being used with the printer, cockling may occur even before the media has been printed on due to the heating of the substrate.

Further, as used in the present specification and in the appended claims, the term "media" is to be understood as any substrate upon which ink may be deposited onto. For example, a sheet of media may be made out of paper, plastic, wood or metal.

Still further, as used in the present specification and in the appended claims "printing conditions" is to be understood as any condition under which a printer is printing on a media or substrate. For example, printing conditions may take into account the various sizes of a media, thickness of a media, current humidity levels, advancement of the media through the printer, the type of ink used in printing, the shape of the ribs perpendicularly coupled to the platen, the cockling pattern of the media, and any other condition under which a printer's printing characteristics may change.

Even further, as used in the present specification and in the appended claims "skew" is to be understood as having an oblique direction or position. Skew may also be know in the art as differential media advance and describes the advancement of a media through a printer at different rates and at different locations along the printed area of the media.

Turning now to FIG. 1, an illustrative system (100) for diagnosing printing issues includes a computing device (105) which also includes a processor (110), a user interface (120), a computer readable memory (115) and hardware adapters (125). The computing device (105) is in communication with a printer (135) through a network connection (130). The printer (135) generates a diagnostic plot (140) on a sheet of media (145) by which the user may refer to in order to adjust the printing properties of the printer (135). The properties or settings of the printer (135) may be adjusted via a printer user interface (180) associated with the printer (135). Each of these will now be discussed in more detail.

The system (100) includes a computing device (105) through which the user may cause a diagnostic plot (140) to be printed on a printer (135). As briefly discussed above, the computing device (105) includes a user interface (120) through which the user may interact with the computing device (105). A user interface devices may include, for example, a mouse, a keyboard, a monitor, a touch screen or any other hardware or machine readable instructions which allows a user to interact with the computing system (105).

The computing device (105) further comprises a processor (110) which is capable of receiving input from a user via a user interface (120). The processor (110) processes, interprets, and executes programmed instructions received from the computer readable memory (115). Through the processor, the user may send instructions through the network connection (130) in order to direct the printer (135) to print out a diagnostic plot (140). For example, the computing device (105) may send to the printer (135) instructions to print out a diagnostic plot upon which the printer's (135) firmware interprets these instructions and begins to print a diagnostic plot which has been saved on the printer's (135) internal memory. In another example, however, the computing device (105) may send both the instructions and the data related to the diagnostic plot for the printer (135) to interpret and print out. Therefore, the computing device (105) may also be capable of not only providing instructions to the printer (135) but also providing image data to the printer (135). The computing device (105) also comprises computer readable memory (115). The computer readable memory may include either volatile memory or non-volatile memory and may include computer usable program code embodied therewith which is processed, interpreted and executed by the processor (110). Specifically, as will be discussed later, the memory may be a non-transitory computer readable medium having computer usable program code embodied therewith wherein the computer usable program code comprises a computer usable program code configured to generate a diagnostic plot on a sheet of media being sent through the printing device. Additionally, the computer useable code may be configured to accept adjustments to printing parameters on the printing device based on printing defects displayed on the diagnostic plot.

Additionally, the computing device (105) further includes hardware adapters (125) which enable the processor (110) to interface with various other hardware elements, external and internal to the computing device (105). For example, hardware adapters (125) may provide an interface to the user interface (120) devices to create a user interface and/or access external or internal sources of computer readable memory (115). Hardware adapters (125) may also create an interface between the processor (110) and the printer (135) or other media output device. For example, when the computing device (105) generates a diagnostic plot (140), the computing device (105) may instruct the printer (135) to create one or more physical copies of the diagnostic plot (140).

The system (100) further comprises a printer (135) which, upon receipt of instructions from the computing device (105), prints out a diagnostic plot (140). The diagnostic plot (140) is then used by the user to adjust various aspects of the printer (135) operation in order to achieve optimal print quality. Specifically, the user may adjust the vacuum levels associated with the vacuum system coupled to the platen of the printer (135). As discussed previously this vacuum system includes a source of negative pressure coupled to the printer via a number of holes defined in the platen of the printer. The vacuum system uses this negative pressure to hold a sheet of media to the platen while the printer (135) is printing on the media. Much like the memory (115) and processor (110) on the computing device (105), the printer (135) may also include a memory (150) and processor (160). The memory (150) may be a non-transitory computer readable medium having computer usable program code embodied therewith wherein the computer usable program code comprises a computer usable program code configured to generate a diagnostic plot on a sheet of media being sent through the printer (135). Additionally, the computer useable code may be configured to accept adjustments to printing parameters on the printer (135) based on printing defects displayed on the diagnostic plot. The processor (160) processes, interprets, and executes programmed instructions received from the memory (150). As will be discussed later, the processor (160) may further be configured to receive an image from an optical scanner (155), interpret the image, and provide the user with instructions on how to adjust the printer's (135) settings.

The printer (135) may additionally include a print engine (175) configured to receive signals from the processor (160) to print a diagnostic plot (140) onto a sheet of media (145) during the printing process. Specifically, the print engine (175) may be configured to perform the print-imaging, fixing and paper transport during the printing process.

Additionally, the user may have a need to adjust the skew of the media if the media had been loaded into the printer (135) with too much skew or if the advancement of the media through the printer is not constant along all areas of the advancing media. Still further, the user may have a need to adjust the drying temperature of the drying lamp on the printer. As briefly described above, a drying lamp may be used in connection with the printer (135) in order to dry or cure the ink printed onto the media. It will be appreciated, however, that the printer user interface (180) may be used by the user to adjust various other aspects of the printer (135); vacuum level, media skew and drying temperature being examples.

The system (100) further comprises a diagnostic plot (140) of which combines measurement patterns for cockle, media advance, and skew in the same plot. The diagnostic plot (140), when printed under typical printing conditions such as speed and temperature, assists the user in adjusting these parameters. As discussed above, adjustment of these parameters may prove difficult without specific feedback from the printer (135) as to the current printing conditions represented on any specific type of media.

Figure 2:
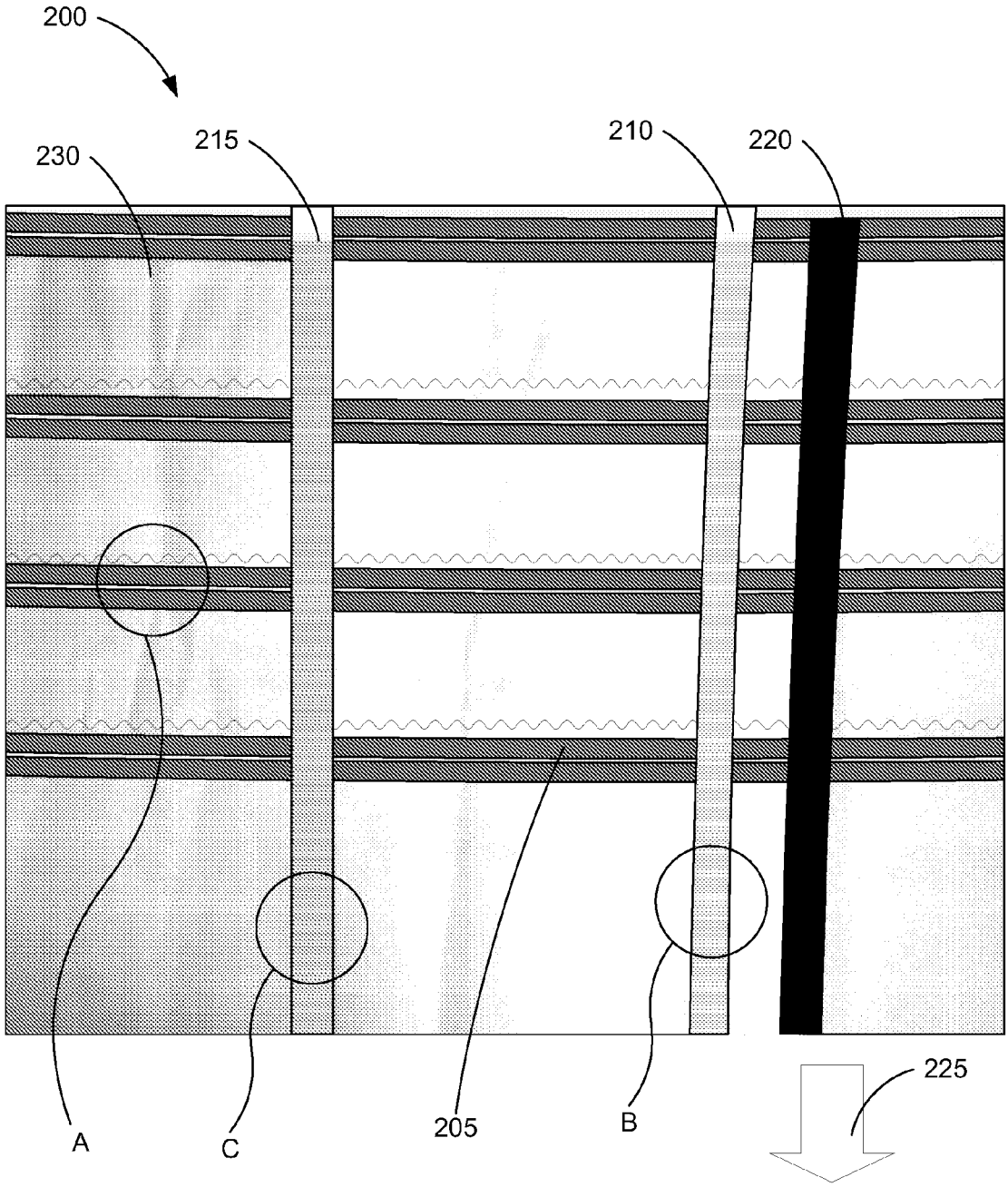
FIG. 2 is an illustrative diagnostic plot, according to one embodiment of principles described herein.

Turning now to FIG. 2, an illustrative diagnostic plot (200) is shown and includes at least one cockle pattern (205), main media advance pattern (210), secondary media advance pattern (215), an inked band (220), and representative cockling (230). Each of these will now be described in connection with FIGS. 3A, 3B, 4A, 4B, 4C, 5A and 5B. For purposes of explanation, the diagnostic plot of FIG. 2 is printed in the direction of the arrow (225). However, it can be appreciated that the printing direction can be accomplished via any direction.

As briefly discussed above, a heat lamp or drying lamp (FIG. 1, 185) may be associated with the printer (FIG. 1, 135) and may help to dry or cure the ink deposited on the media during printing. However, as a consequence of using a drying lamp (FIG. 1, 185) to dry the ink, the media may cockle leading to poor quality in the printed document or damage to the printer. The cockling effect is especially prevalent when plastic-based media such as vinyl is used.

Therefore, in order to prevent this from occurring, a thermal sensor (FIG. 1, 165) may also be associated with the printer (FIG. 1, 135) which measures the temperature of the media at any number of locations. An inked band (220) is therefore printed on the media to emulate a situation where an average amount of ink has been deposited on the media. Therefore, when the inked band (220) is printed on the media, the thermal sensor (FIG. 1, 165) detects the temperature of that band (220) and sends signals to a heating servo (FIG. 1, 170) which in turn increases or decreases the temperature of the drying lamp (FIG. 1, 185). For example, if the temperature of the inked band (220) was measured by the thermal sensor (FIG. 1, 165) as being hotter than may be necessary to dry the ink, the thermal sensor (FIG. 1, 165) may relay a signal to the heating servo (FIG. 1, 170) to provide less energy to the drying lamp (FIG. 1, 185). Reduction of heat from drying lamp (FIG. 1, 185) thereby prevents unnecessary cockling of the media while still providing a way for the ink to be dried or cured.

Figure 3A:
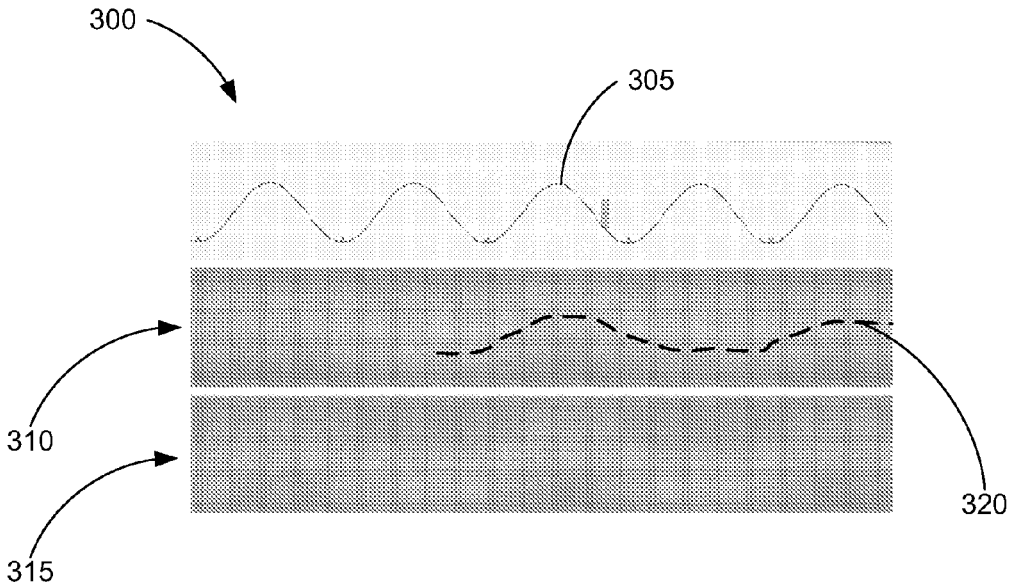
FIG. 3A is an illustrative view of the diagnostic plot of FIG. 2 within circle A depicting an illustrative cockle pattern under a condition where the vacuum level is too low, according to one embodiment of principles described herein.

Continuing to refer to FIG. 2 and looking now at FIG. 3A, an illustrative view of the diagnostic plot of FIG. 2 within circle A depicts an illustrative cockle pattern (300) under a condition where the vacuum level is too low. The cockle pattern of FIG. 3A includes a reference platen ruler (305), a first interference pattern (310), and a second interference pattern (315). These will now be described in more detail.

The reference platen ruler (305) comprises an ink line which has been printed on the diagnostic plot (FIG. 2, 200). The reference platen ruler (305) reflects the true pattern of the ribs along the platen and thereby reflects or represents the expected cockle pattern of the printer (FIG. 1, 135). The printer's (FIG. 1, 135) platen may have a number of ribs coupled perpendicular to the platen which helps to support the media being fed into the printer (FIG. 1, 135), better dry the deposited ink, and reduce friction between the print media and the platen. Because these ribs are coupled to the platen, a certain cockling pattern is expected. This pattern is therefore represented in the reference platen ruler (305).

The cockle pattern (300) further includes a first interference pattern (310) which represents the actual cockle pattern occurring on the printer (FIG. 1, 135) under the current printing conditions. The first interference pattern (310) is made of a combination of stride and stepped lines. Stride lines are printed on the media when the carriage is printing from the right to left direction while stepped lines are printed while the carriage is printing from left to the right. Therefore the vertical position of each point printed on the first interference pattern (310) reflects the distance between the print head of the printer (FIG. 1, 135) and the media at the time of printing. The change in distance between the print head of the printer (FIG. 1, 135) and the media is thereby shown as an interference pattern having a lighter shaded area or light band throughout the pattern. Specifically, a light band is produced when the stepped lines and stride lines coincide. This is because at the points where the stride and stepped lines coincide, a relatively larger non-inked gap between lines is formed which gives the perception of a lighter band. For ease of understanding, the general pattern of the light band in the first interference pattern (310) has been indicated by a dashed black line (320). Therefore, when the stride lines have been displaced relatively further to the left, the light band on the cockle pattern (300) is relatively higher vertically on the cockle pattern (300). The opposite is true as well; when the stride lines have been displaced relatively to the right, the light band on the cockle pattern (300) is relatively lower vertically on the cockle pattern (300).

It can be appreciated that a second interference pattern (315) may be printed along with the first interference pattern (310) showing a second interference pattern (315) corresponding to a second printhead or row of printheads in the printer (FIG. 1, 135). For purposes of example only, the present exemplary embodiment uses both a first (310) and second (315) interference patterns; these interference patterns corresponding to their respective printheads in the printer (FIG. 1, 135). It can be further appreciated that with a printer having two or more printheads or two or more rows of printheads, the performance of each printhead or row of printheads may be represented by a corresponding interference pattern in order to provide comparison to the reference platen ruler (305) with regards to the performance of those additional printheads. Having each printhead or row of printheads generate an interference pattern allows the user to determine which printhead or row of printheads is experiencing problems. The second interference pattern (315) may be printed directly below the first interference pattern (310) or any other location on the media. As will be discussed later, it may be further appreciated that a number of interference patterns (310, 315) may be printed along the media so as to make finer adjustments to the printer (FIG. 1, 135) during printing of the diagnostic plot.

When the first and second interference patterns (FIG. 3A, 310, 315) are compared to the reference platen ruler (305), the patterns do not match. This indicates that the printing parameters of the individual printheads are not acceptable or otherwise accurate. This, therefore, may indicate to the user that the vacuum level is too low. As will be discussed in more detail below, the vacuum level may need to be adjusted on the printer (FIG. 1, 135) accordingly. Failure to properly adjust the vacuum level may therefore produce a finished product having vertical bands matching the improper cockle pattern as reflected in the first or second interference patterns (310, 315).

Figure 3B:
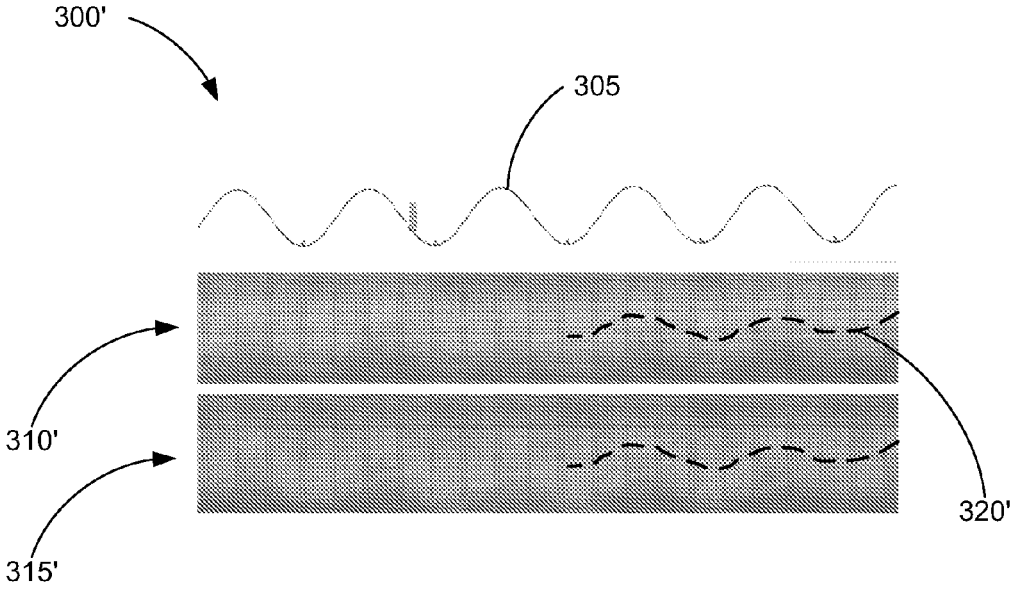
FIG. 3B is an illustrative view of the diagnostic plot of FIG. 2 within circle A depicting an illustrative cockle pattern under appropriate vacuum level conditions, according to one embodiment of principles described herein.

Turning now to FIG. 3B, an illustrative view of the diagnostic plot of FIG. 2 within circle A depicting an illustrative cockle pattern under appropriate vacuum level conditions is shown. Unlike FIG. 3A, the interference patterns (310', 315', 320') depicted in FIG. 3B generally have the same cockle pattern as that of the reference platen ruler (305). This, therefore, indicates to the user that the vacuum level under the current parameters is at its optimal level.

It can be appreciated that the cockle pattern (300) or diagnostic plot (FIG. 1, 145; FIG. 2, 200), may, in addition to or in replace of the interference patterns (310, 310', 315, 315'), comprise a set of fiducials. Therefore, in one exemplary embodiment, the cockle pattern (300) may include a set of fiducials printed on the media based upon output from a sensor such as a line sensor or charge-couple device (CCD) camera.

Figure 4A:
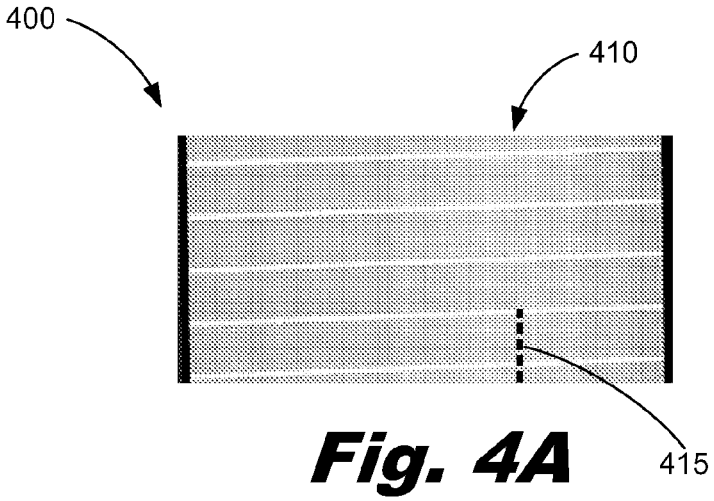
FIG. 4A is an illustrative view of the diagnostic plot of FIG. 2 within circle B depicting an illustrative main media advance pattern with a uniform light band which is not centered, according to one embodiment of principles described herein.

Continuing to refer to FIG. 2 and looking now at FIG. 4A, an illustrative view of the diagnostic plot of FIG. 2 within circle B depicting an illustrative main media advance pattern (400) with a uniform light band (410) which is not centered is shown. The main media advance pattern (400) is printed in order to determine whether the media is over advancing through the printer (FIG. 1, 135) or under advancing through the printer (FIG. 1, 135). As can be seen in FIG. 4A, a relatively lighter light band (410) is printed vertically throughout the interference pattern of the main media advance pattern (400). The light band (410) helps indicate to the user whether the printer (FIG. 1, 135) is properly advancing the media. Similar to the formation of the cockle patterns (300) of FIGS. 3A and 3B, the light band in the main media advance pattern (400) is created by coinciding printed lines as the printer's (FIG. 1, 135) carriage prints the main media advance pattern (400).

In the case of FIG. 4A, a uniform, but not centered lighter band (410) may indicate that the user should adjust the media advance on the printer (FIG. 1, 135) until the lighter band (410) is centered along the main media advance pattern (400). For ease of understanding, the general pattern of the light band (410) in the main media advance pattern (400) has been indicated by a dashed black line (415). Adjustment of the media advance will be discussed below.

Figure 4B:
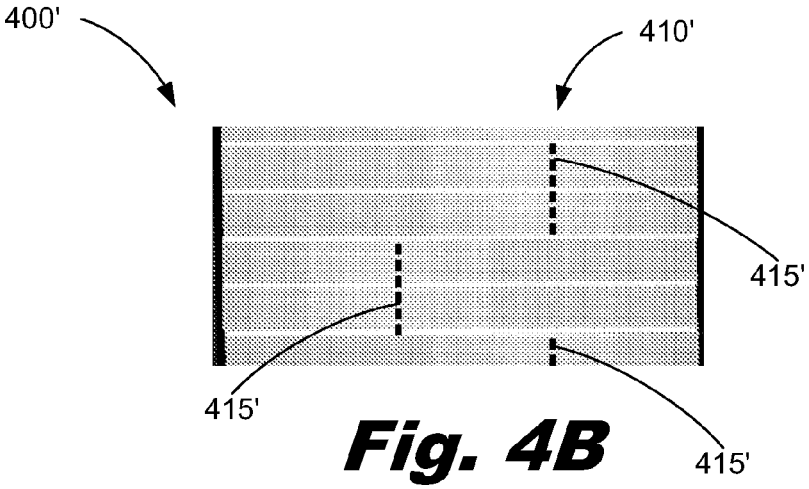
FIG. 4B is an illustrative view of the diagnostic plot of FIG. 2 within circle B depicting an illustrative main media advance pattern with a light band which is not uniform and not centered, according to one embodiment of principles described herein.

Looking now at FIG. 4B, another illustrative view of the diagnostic plot of FIG. 2 within circle B depicting an illustrative main media advance pattern (400') with a light band (410') which is not uniform is shown. The relatively lighter band (410') is not centered and not uniform along the main media advance pattern (400'). As discussed above, this may indicate that the user should adjust the media advance on the printer (FIG. 1, 135) until the light band (410') is centered along the main media advance pattern (400). In addition however, this may indicate to the user that the vacuum level may be too high. Therefore, the light band (410') shown in FIG. 4B would indicate to the user that both the media advance and vacuum levels of the printer (FIG. 1, 135) need to be adjusted appropriately in order to achieve optimum printing conditions. Again, for ease of understanding, the general pattern of the light band (410') in the main media advance pattern (400') has been indicated by a dashed black line (415').

Figure 4C:
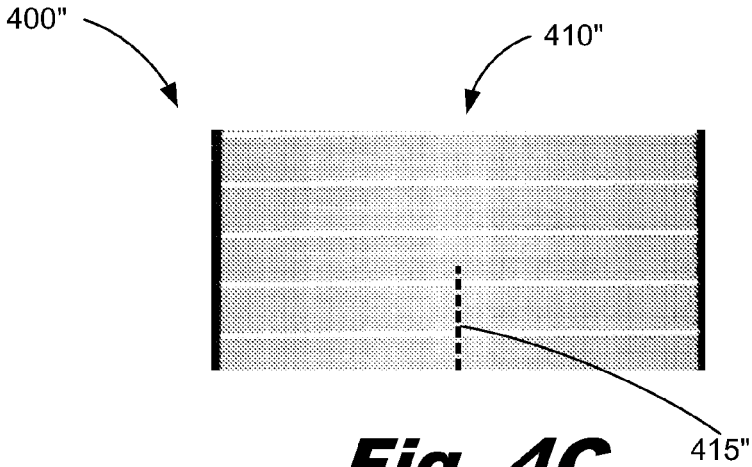
FIG. 4C is an illustrative view of the diagnostic plot of FIG. 2 within circle B depicting an illustrative main media advance pattern with a uniform light band which is centered, according to one embodiment of principles described herein.

Turning now to FIG. 4C, an illustrative view of the diagnostic plot of FIG. 2 within circle B depicting an illustrative main media advance pattern (400") with a uniform light band (410") which is centered is shown. A condition where the light band (410") is centered and uniform throughout the main media advance pattern (400") could indicate that the user does not need to adjust any printing qualities of the printer (FIG. 1, 135). This is because the light band (410") is centered about main media advance pattern (400") indicating that the advancement of the media through the printer (FIG. 1, 135) has been properly adjusted and is therefore working properly under current printing conditions. Additionally, the user does not need to adjust the printer's (FIG. 1, 135) printing qualities because the uniformity of the light band (410") has indicated that the vacuum levels have been properly adjusted and working properly under the current printing conditions. Again, for ease of understanding, the general pattern of the light band (410") in the main media advance pattern (400") has been indicated by a dashed black line (415").

Figure 5A:
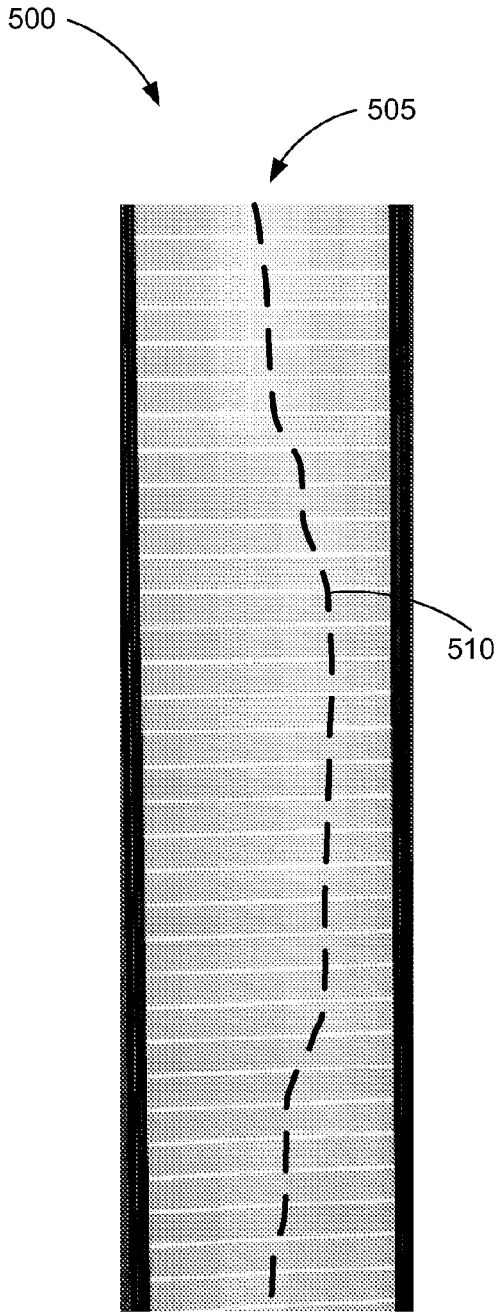
FIG. 5A is an illustrative view of the diagnostic plot of FIG. 2 within circle C depicting an illustrative secondary media advance pattern with a non-uniform light band, according to one embodiment of principles described herein.
Figure 5B:
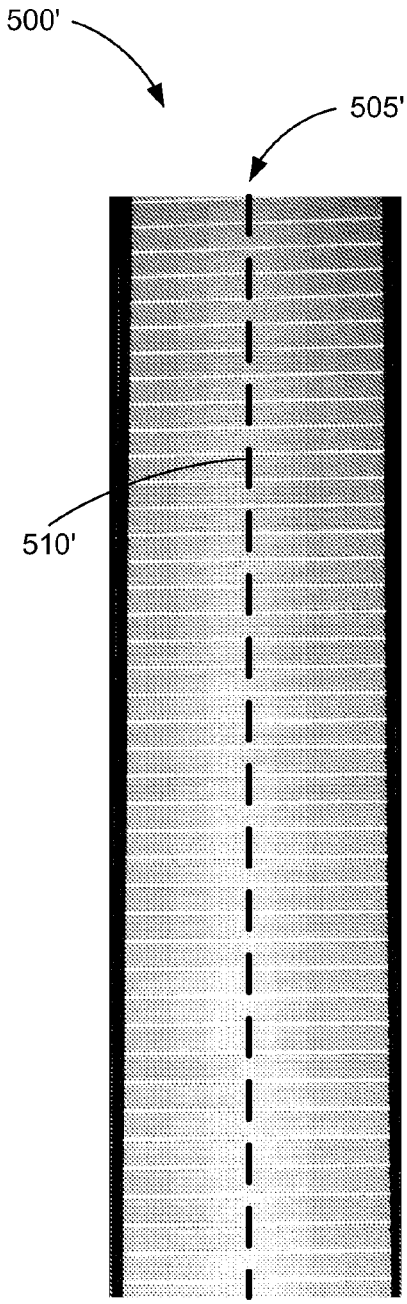
FIG. 5B is an illustrative view of the diagnostic plot of FIG. 2 within circle C depicting an illustrative secondary media advance pattern with a uniform light band, according to one embodiment of principles described herein.

Similar to the formation of the cockle patterns (300) of FIGS. 3A and 3B, the light band in the secondary media advance pattern (FIG. 5A, 500 and FIG. 5B, 500') is created by coinciding printed lines as the printer's (FIG. 1, 135) carriage prints the secondary advance patterns (400; FIG. 5A, 500; FIG. 5B, 500').

Continuing to refer to FIG. 2 and looking now at FIG. 5A, an illustrative view of the diagnostic plot of FIG. 2 within circle C depicting an illustrative secondary media advance pattern (500) with a non-uniform light band is shown. Much like the main media advance patterns (FIG. 4A, 400; FIG. 4B, 400'; FIG. 4C, 400"), the secondary media advance pattern (500) helps the user determine the media advance quality at that specific point in the substrate. Specifically, FIG. 5A shows an interference pattern having a non-uniform light band (505) which is, at some points centered along the secondary media advance pattern (500), but at some points is not centered along the main media advance pattern (FIG. 4A, 400; FIG. 4B, 400'; FIG. 4C, 400"). For ease of understanding, the general pattern of the light band (505) in the secondary media advance pattern (500) has been indicated by a dashed black line (510). Much like FIG. 4B, a non-uniform and non-centered light band (505) may indicate to the user that both the media advance and vacuum levels of the printer (FIG. 1, 135) need to be adjusted appropriately in order to achieve optimum printing conditions. Besides examining the secondary media advance pattern (FIG. 5A, 500; FIG. 5B, 500') for the problems described above, the secondary media advance pattern (500) may be compared to the main media advance pattern (FIG. 4A, 400; FIG. 4B, 400'; FIG. 4C, 400"). This is done in order to determine whether all points of the media are being advanced properly through the printer (FIG. 1, 135). As briefly indicated above, advancement of the media through the printer at different rates horizontally along the printed area results in skew or differential media advance which will result in an inferior output from the printer (FIG. 1, 135).

As can be seen in FIG. 5B, an illustrative view of the diagnostic plot of FIG. 2 within circle C depicting an illustrative secondary media advance pattern with a uniform light band (505') is shown. Again, for ease of understanding, the general pattern of the lighter band in the secondary media advance pattern (500') has been indicated by a dashed black line (510'). Much like FIG. 4C, a condition where the light band (505') is centered and uniform throughout the secondary media advance pattern (500') could indicate that the user need not adjust any printing qualities of the printer (FIG. 1, 135). This is because the light band (505') is centered about the secondary media advance pattern (500') indicating that the advancement of the media through the printer (FIG. 1, 135) has been properly adjusted and is therefore working properly under current printing conditions. Additionally, the user need not adjust the printer's (FIG. 1, 135) vacuum levels because the uniformity of the lighter band (505') indicates that the vacuum levels have also been properly adjusted and working properly under the current printing conditions.

In addition to the user viewing the secondary media advance pattern (FIG. 5A, 500; FIG. 5B, 500') for any of the issues discussed above, the secondary media advance pattern (FIG. 5A, 500; FIG. 5B, 500') may be compared to the main media advance pattern (FIG. 4A, 400; FIG. 4B, 400'; FIG. 4C, 400") in order to determine if the secondary media advance pattern (FIG. 5A, 500; FIG. 5B, 500') is showing any issues with the current printing conditions. An optical media sensor, or a sensor which measures and corrects for any advancement of the media, may be placed over the main media advance pattern (FIG. 4A, 400; FIG. 4B, 400'; FIG. 4C, 400") and thereby correct any deviations found in the main media advance pattern (FIG. 4A, 400; FIG. 4B, 400'; FIG. 4C, 400") while printing the diagnostic plot (FIG. 2, 200). This may create a situation where the main media advance pattern (FIG. 4A, 400; FIG. 4B, 400'; FIG. 4C, 400") looks to be fine, but the secondary media advance pattern (FIG. 5A, 500; FIG. 5B, 500') may in fact be encountering problems. Under optimal printing conditions, both the main media advance pattern (FIG. 4A, 400; FIG. 4B, 400'; FIG. 4C, 400") and secondary media advance pattern (FIG. 5A, 500; FIG. 5B, 500') should look similar. However, for example, if the vacuum level was set too high, the main media advance pattern (FIG. 4A, 400; FIG. 4B, 400'; FIG. 4C, 400") will be corrected by the optical media sensor. However, problems may still occur at the location of the media where the secondary media advance pattern (FIG. 5A, 500; FIG. 5B, 500') is being printed because the media may be advancing through the printer (FIG. 1, 135) at that location at a different rate than that of the main media advance pattern (FIG. 4A, 400; FIG. 4B, 400'; FIG. 4C, 400") thereby skewing the media. Therefore, to achieve the best printing results, the user compares the secondary media advance pattern (FIG. 5A, 500; FIG. 5B, 500') to the main media advance pattern (FIG. 4A, 400; FIG. 4B, 400'; FIG. 4C, 400") as well as examining the secondary media advance pattern (FIG. 5A, 500; FIG. 5B, 500') alone for any defects.

It should be appreciated that, although the illustrative cockle patterns (FIG. 3A, 300; FIG. 3B, 300'), main media advance patterns (FIG. 4A, 400; FIG. 4B, 400'; FIG. 4C, 400"), and secondary media advance patterns (FIG. 5A, 500; FIG. 5B, 500') are shown on the diagnostic plot (FIG. 2, 200) as being printed a set number of times on the diagnostic plot (FIG. 2, 200), any number of cockle patterns (FIG. 3A, 300; FIG. 3B, 300'), main media advance patterns (FIG. 4A, 400; FIG. 4B, 400'; FIG. 4C, 400"), and secondary media advance patterns (FIG. 5A, 500; FIG. 5B, 500') may be printed on the media. In one illustrative example, the user may be allowed to determine how many cockle patterns (FIG. 3A, 300; FIG. 3B, 300'), main media advance patterns (FIG. 4A, 400; FIG. 4B, 400'; FIG. 4C, 400"), and secondary media advance patterns (FIG. 5A, 500; FIG. 5B, 500') are printed on the diagnostic plot (FIG. 2, 200). Therefore, should the user intend to make an extensive evaluation of the current printing conditions of the printer (FIG. 1, 135), he or she may adjust the diagnostic plot (FIG. 2, 200) printout so as to print more of each of the cockle patterns (FIG. 3A, 300; FIG. 3B, 300'), main media advance patterns (FIG. 4A, 400; FIG. 4B, 400'; FIG. 4C, 400"), and secondary media advance patterns (FIG. 5A, 500; FIG. 5B, 500').

Figure 6:
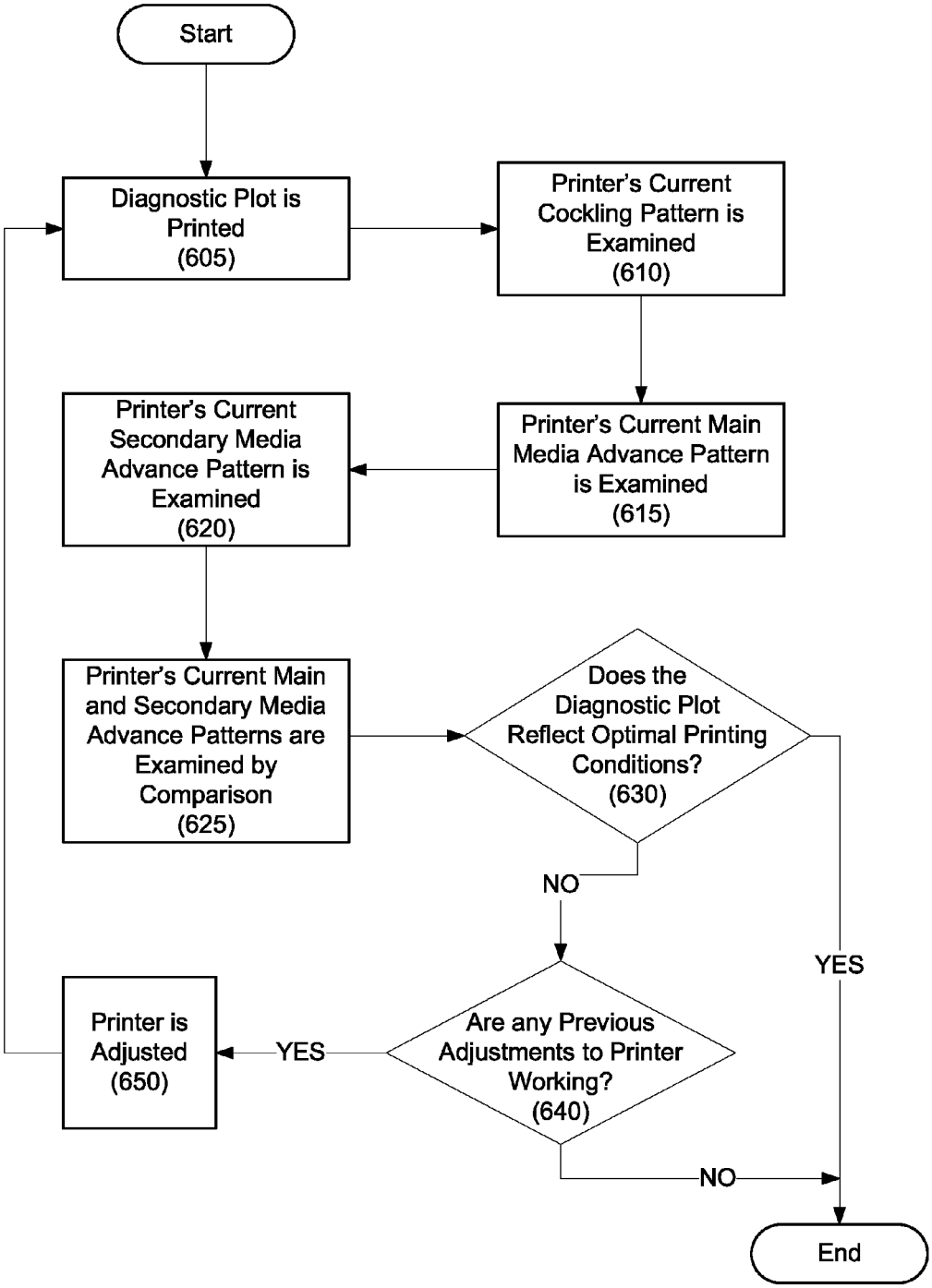
FIG. 6 is a flowchart describing an illustrative method for diagnosing and correcting printing abnormalities using the diagnostic plot, according to one embodiment of the principles described herein.

Turning now to FIG. 6, a flowchart describing an illustrative method for diagnosing and correcting printing abnormalities using the diagnostic plot (FIG. 2, 200) is shown. According to the method a diagnostic plot is first printed out (Block 605) on the printer (FIG. 1, 135). For purposes of this example, it is assumed that the diagnostic plot (FIG. 2, 200) is being printed using the printer's (FIG. 1, 135) current printing parameters. However it can be appreciated that as the user changes the media upon which the printer is to print on, the printer (FIG. 1, 135) may, through different sensors, determine that a change has been made in media, access what type of media is being used, and adjust the printer's (FIG. 1, 135) printing parameters to a general preset corresponding to that type of media. It may also be appreciated that the user may indicate via the printer's user interface (FIG. 1, 180) what type of media is being used and the printer may then adjust the printer's (FIG. 1, 135) printing parameters to a general preset corresponding to that type of media.

After the diagnostic plot (FIG. 2, 200) has been printed, the diagnostic plot's (FIG. 2, 200) cockle pattern representing the pattern of the printer's (FIG. 1, 135) ribs is examined (Block 610) to determine if the cockle pattern mimics the reference platen ruler (FIGS. 3A and 3B, 305). As discussed above the first and second interference patterns (310, 315, 310', 315') reflect the actual cockle pattern of the printer. In comparing the first and second interference patterns (310, 315, 310', 315') with the reference platen ruler (305), the user may determine if the interference patterns (310, 315, 310', 315') follow at least the shape of the reference platen ruler (FIGS. 3A and 3B, 305). Through this, the user will determine to what extent the vacuum levels of the printer's (FIG. 1, 135)

vacuum system should be adjusted. It can be appreciated that the interference patterns (310, 315, 310', 315') may only match the reference platen ruler (FIGS. 3A and 3B, 305) by a certain degree and therefore, the two patterns could be matched up to a certain threshold before it is decided that the vacuum levels of the printer's (FIG. 1, 135) vacuum system should be adjusted.

In addition to examining the current cockling pattern (Block 610), the user also examines (Block 615) the diagnostic plot's (FIG. 2, 200) current main media advance pattern (FIG. 4A, 400; FIG. 4B, 400'; FIG. 4C, 400"). As described above, the main media advance pattern (FIG. 4A, 400; FIG. 4B, 400'; FIG. 4C, 400") may indicate that the advancement of the media through the printer (FIG. 1, 135) may need to be adjusted and the user takes note of this for later adjustment of the media advance feature of the printer (FIG. 1, 135).

The user then examines (Block 620) the diagnostic plot's (FIG. 2, 200) secondary media advance pattern (FIG. 5A, 500; FIG. 5B, 500'). This pattern is also examined much like the main media advance pattern (FIG. 4A, 400; FIG. 4B, 400'; FIG. 4C, 400") and the user takes note of any irregularities for later adjustment of the media advance feature of the printer (FIG. 1, 135) should any irregularities exist.

The user also examines the main media advance pattern (FIG. 4A, 400; FIG. 4B, 400'; FIG. 4C, 400") and secondary media advance pattern (FIG. 5A, 500; FIG. 5B, 500') further by comparing (Block 625) them to each other. This is done so as to determine whether the different locations of the media upon which the secondary media advance pattern (FIG. 5A, 500; FIG. 5B, 500') has been printed on is experiencing different advancement issues than what is being experienced by the main media advance pattern (FIG. 4A, 400; FIG. 4B, 400'; FIG. 4C, 400"). Specifically, if the vacuum level is too high, the printer (FIG. 1, 135) may adjust the advancement of the media at the location of the main media advance pattern (FIG. 4A, 400; FIG. 4B, 400'; FIG. 4C, 400") because that portion of the media is being monitored as described above. However, other portions of the media may not be monitored and therefore, the portion of the media upon which the secondary media advance pattern (FIG. 5A, 500; FIG. 5B, 500') has been printed on may be subjected to different advancement rates. As described above, this causes the media to skew and will lead to a finished printed product that is relatively inferior.

After viewing and examining these various parts of the diagnostic plot (FIG. 2, 200), the user then determines (Block 630) if the diagnostic plot reflects optimal printing conditions under the current printer (FIG. 1, 135) settings. If the diagnostic plot indicates that either the vacuum level, media advance or media skew need to be adjusted, the user then determines (Block 640) whether any previous adjustments have been made to the printer settings and whether those adjustments are adjusting the printer (FIG. 1, 135) such that further adjustments to the printer (FIG. 1, 135) may produce optimal printing conditions. If the diagnostic plot indicates that either the vacuum level, media advance or media skew need to be adjusted and that further adjustments would produce optimal printing conditions, the user adjusts (Block 650) those parameters of the printer. As briefly discussed earlier, the user does this by adjusting various parameters through the printer user interface (FIG. 1, 180).

If, however, the diagnostic plot indicates that either the vacuum level, media advance or media skew can't be adjusted and/or that further adjustments would not produce optimal printing conditions, the user may then have to abandon using that certain type of media in the printer (FIG. 1, 135). Therefore, although the diagnostic plot (FIG. 2, 200) may inform the user how to adjust the properties of the printer (FIG. 1, 135) so as to achieve the most optimal printer output, the diagnostic plot (FIG. 2, 200) may further notify the user that the type of media the user is currently using may not be the best type of media to use in the printer currently being used. Therefore, when both or either of the media advance patterns (FIG. 2, Circle C; FIG. 4A, 400; FIG. 4B, 400'; FIG. 4C, 400"; FIG. 5A, 500; FIG. 5B, 500') or cockle patterns (FIG. 2, Circle A; FIG. 3A, 300; FIG. 3B, 300') show that any adjustments to the media advance properties or vacuum properties of the printer (FIG. 1, 135) are not improving the output of the printer (FIG. 1, 135), then this may indicate to the user that the type of media is not compatible with the printer (FIG. 1, 135) being used and that the user should look to other types of media with different characteristics.

Once the user has adjusted (Block 650) the parameters of the printer (FIG. 1, 135), the process may start over again with the user again causing the printer to print (Block 605) another diagnostic plot (FIG. 2, 200) which now reflects those changes made to the printer (FIG. 1, 135). Again the user examines (Blocks 610-625) the diagnostic plot (FIG. 2, 200) and determines (Block 630) if the diagnostic plot reflects optimal printing conditions under the new printer (FIG. 1, 135) settings. If the diagnostic plot (FIG. 2, 200) reflects the optimal printing conditions, then the method for diagnosing and correcting printing abnormalities using the diagnostic plot ends and the user may continue to use the printer (FIG. 1, 135) at those settings under those conditions.

It may be appreciated that once the user has set the printer (FIG. 1, 135) to print a diagnostic plot under a certain set of printing conditions, the user may save those settings on the printer (FIG. 1, 135) for future use. For example, once a user has adjusted the printer (FIG. 1, 135) for any specific type of media according to the method described above, he or she may create a preset within the printer (FIG. 1, 135). This may, therefore, allow the user to reuse those settings created for that type of media when the printer has subsequently been adjusted for another type of media or for another set of conditions.

It may also be appreciated that the user may adjust the printing parameters as discussed above on the fly. Specifically, while the printer is printing the diagnostic plot (FIG. 2, 200), the user may, through the printer user interface (FIG. 1,180), adjust the vacuum levels and media advance speeds thereby correcting media skew, media advance and media cockling issues during diagnostic printing. Therefore, in one exemplary embodiment, a set of first and second interference patterns (FIGS. 3A and 3B, 310, 310', 315, 315') may be analyzed during printing of a first cockle pattern (FIGS. 3A and 3B; 300, 300'). As seen in FIG. 2, a number of sets of cockle patterns (FIGS. 3A and 3B, 300, 300') may be printed on the media so that during printing the effects of any adjustments of the printing parameters may be seen. Therefore, after the user has reviewed the first cockle pattern (FIGS. 3A and 3B, 300, 300'), the appropriate adjustments may be made to the printer (FIG. 1, 135) as described above. The effects of these adjustments to the printer (FIG. 1, 135) can then be seen in a second set of cockle patterns (FIGS. 3A and 3B, 300, 300') and the user then has another chance to implement additional or finer adjustments based on the new cockle pattern (FIGS. 3A and 3B, 300, 300') printed on the media. This step may be repeated any number of times until the printer (FIG. 1, 135) is printing under the most optimal conditions or the user is at least satisfied with the output. A similar process may also be implemented on the fly for both the main media advance pattern (400) and secondary media advance pattern (FIG. 5A, 500 and FIG. 5B, 500').

It may further be appreciated that the printer itself may adjust the printing parameters during or after printing the diagnostic plot (FIG. 2, 200). Specifically, the printer (FIG. 1, 135) may further comprise an optical scanner (FIG. 1, 155) wherein the optical scanner (FIG. 1, 155), during or after printing the diagnostic plot (FIG. 2, 200), scans the diagnostic plot (FIG. 2, 200). The scanned image of the diagnostic plot (FIG. 2, 200) may be sent to a processor (FIG. 1, 160) located on the printer (FIG. 1, 135) or separate from the printer which then determines how to adjust the parameters of the printer (FIG. 1, 135) as described above. In one exemplary embodiment, the printer (FIG. 1, 135) may adjust the vacuum level of the printer (FIG. 1, 135) according to a given table of values, and then presents the output to the user. The user then could choose the appropriate levels and set them as the default or preset of the printer.

In conclusion, the specification and figures describe a diagnostic plot for adjusting printing characteristics. Through the diagnostic plot, the vacuum level of a vacuum system of the printer may be adjusted. Additionally, through the diagnostic plot, the temperature of a drying source associated with the printer and configured to dry the ink on a substrate may be adjusted. Still further, through the diagnostic plot, the advancement of the media through the printer may be adjusted. This diagnostic plot for adjusting printing characteristics may have a number of advantages, including: better quality of printed material over a number of different types of media, conservation of media through prior adjustment of printing parameters, ease of use for the end user by providing a concise and easy to understand diagnostic plot, and optimal operation of the printing device under the best conditions possible for that printing device.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing device configured to print a diagnostic plot, the diagnostic plot comprising:
- a cockle pattern;
- a main media advance pattern; and
- a secondary media advance pattern;
- wherein the cockle pattern, main media advance pattern, and secondary media advance pattern are for providing feedback and for adjusting printing characteristics associated with the printing device;
- in which the cockle pattern comprises:
- a reference platen rule comprising a pattern representing an expected shape of the cockle pattern printed by the printing device; and
- a number of interference patterns each comprising a light band representing an actual cockle pattern printed by the printing device under current printing conditions.

2. The printing device plot of claim 1, in which the light band within the number of interference patterns are configured to be compared to the platen ruler to determine how to adjust vacuum levels of a vacuum system associated with a printing device.

3. The printing device of claim 1, in which the main media advance pattern is in a form of an interference pattern with a relatively lighter band there through and represents a rate of advancement of the media through the printing device at a location on the media where the main media advance pattern is printed.

4. The printing device of claim 3, further comprising:
- an optical scanner that captures an image of the diagnostic plot; and
- a processor communicatively coupled to the optical scanner;
- in which the processor receives the image of the diagnostic plot captured by the optical scanner, and determines whether the lighter band along the main media advance pattern is centered and uniform along the length of the main media advance pattern, and
- in which the processor determines how to adjust vacuum levels of a vacuum system associated with the printing device, adjust media advance characteristics of the printing device, or combinations thereof.

5. The printing device of claim 1, in which the secondary media advance pattern is in a form of an interference pattern with a relatively lighter band there through and represents:
- a rate of advancement of the media through the printing device at the location on the media where the secondary media advance pattern is printed; and
- the rate of advancement of the media through the printing device at a location on the media where the secondary media advance pattern is printed with respect to the rate of advancement of the media represented by the main media advance pattern at the location on the media where the main media advance pattern is printed.

6. The printing device of claim 5, in which the relatively lighter band throughout the secondary media advance pattern is configured to be compared to the relatively lighter band throughout the main media advance pattern to determine how to adjust a rate of advancement of the media through the printing device, the vacuum levels of a vacuum system associated with a printing device, a temperature of a heating source associated with the printing device, or combinations thereof.

7. A printing device configured to print a diagnostic plot, the printing device comprising:
- a processor;
- a print engine communicatively coupled to the processor; and
- a thermal sensor;
- wherein the diagnostic plot comprises:
  - a cockle pattern;
  - a main media advance pattern; and
  - a secondary media advance pattern;
  - wherein the cockle pattern, main media advance pattern, and secondary media advance pattern are for providing feedback and for adjusting printing characteristics associated with the printing device;
- in which the diagnostic plot further includes an inked band having a temperature that can be measured by the thermal sensor associated with the printing device during printing.

8. The printing device of claim 7, in which information relating to the measured temperature of the inked band is provided to a heating servo which adjusts the temperature of a drying source coupled to the printing device.

9. A printing device configured to print a diagnostic plot, the printing device comprising:
- a processor;
- a print engine communicatively coupled to the processor; and
- an optical scanner for scanning the diagnostic plot when printed;
- wherein the print engine receives instructions from the processor to print the diagnostic plot, the diagnostic plot comprising;

a cockle pattern;

a main media advance pattern; and a secondary media advance pattern; and wherein the cockle pattern, main media advance pattern, and secondary media advance pattern are for providing feedback and for adjusting a vacuum system associated with the printing device;

wherein the processor adjusts vacuum levels of the vacuum system using output from the optical scanner from scanning the diagnostic plot.

10. The printing device of claim 9, wherein the cockle pattern comprises:

a reference platen rule comprising a pattern representing an expected shape of the cockle pattern printed by the printing device; and a number of interference patterns each comprising a light band representing an actual cockle pattern printed by the printing device under current printing conditions.

11. The printing device plot of claim 10, in which the light band within the number of interference patterns are configured to be compared to the platen ruler to determine how to adjust vacuum levels of the vacuum system associated with a printing device.

12. The printing device of claim 9, in which the main media advance pattern is in a form of an interference pattern with a relatively lighter band there through and represents a rate of advancement of the media through the printing device at a location on the media where the main media advance pattern is printed.

13. The printing device of claim 9, in which the secondary media advance pattern is in a form of an interference pattern with a relatively lighter band there through and represents:

a rate of advancement of the media through the printing device at a location on the media where the secondary media advance pattern is printed; and the rate of advancement of the media through the printing device at the location on the media where the secondary media advance pattern is printed with respect to the rate of advancement of the media represented by the main media advance pattern at the location on the media where the main media advance pattern is printed.

14. The printing device of claim 9, in which the diagnostic plot further includes an inked band having a temperature that can be measured by a thermal sensor associated with the printing device during printing.

15. A method of adjusting vacuum levels in a vacuum system of a printing device comprising:

generating a diagnostic plot on media; the diagnostic plot including a cockle pattern, a main media advance pattern, and a secondary media advance pattern; and accepting adjustments to the vacuum system of the printing device based on printing defects displayed on the diagnostic plot.

16. The method of claim 15, in which the cockle pattern comprises:

a reference platen rule comprising a representative cockle pattern representing an expected shape of the cockle pattern printed by the printing device; and a number of interference patterns each comprising a light band representing an actual cockle pattern printed by the printing device under current printing conditions;

wherein the light band within the number of interference patterns are compared to the representative cockle pattern within the reference platen ruler to determine how to adjust the vacuum levels of the vacuum system associated with the printing device.

17. The method of claim 15, in which the main media advance pattern and secondary media advance pattern each are in a form of an interference pattern with a light band there through in which the light band throughout the secondary media advance pattern is compared to the light band throughout the main media advance pattern to determine how to adjust a rate of advancement of the media through the printing device, vacuum levels of the vacuum system associated with a printing device, a temperature of a heating source associated with the printing device, or combinations thereof.

18. The method of claim 15, in which the diagnostic plot further comprises an inked band wherein the temperature of the inked band is measured by a thermal sensor associated with the printing device during printing and information relating to the measured temperature of the inked band is provided to the printing device for use in adjusting the temperature of a drying source coupled to the printing device.

19. The method of claim 15, in which the printing device prints the diagnostic plot under a set of predefined vacuum levels and the printing device parameters are adjusted to the best vacuum levels represented on the diagnostic plot.

20. The method of claim 15, in which said diagnostic plot comprises measurement patterns for all of cockle, media advance and skew in a same diagnostic plot.

* * * * *